US007164226B2

(12) United States Patent
Kai et al.

(10) Patent No.: US 7,164,226 B2
(45) Date of Patent: Jan. 16, 2007

(54) HIGH-PRESSURE DISCHARGE LAMP

(75) Inventors: Makoto Kai, Katano (JP); Atsushi Utsubo, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 254 days.

(21) Appl. No.: 10/824,346

(22) Filed: Apr. 15, 2004

(65) Prior Publication Data

US 2004/0227445 A1 Nov. 18, 2004

(30) Foreign Application Priority Data

Apr. 17, 2003 (JP) ..... 2003-112351

(51) Int. Cl.
*H01K 1/18* (2006.01)

(52) U.S. Cl. ..... 313/284

(58) Field of Classification Search ..... 313/283–285, 313/578–579, 573, 17, 25–26, 49, 115, 238, 313/244–245, 11, 637–639; 445/29, 32
See application file for complete search history.

(56) References Cited

U.S. PATENT DOCUMENTS 4,401,913 A * 8/1983 Koza et al. ..... 313/25
6,326,721 B1 12/2001 Shippee et al.
2002/0185974 A1* 12/2002 Nakano et al. ..... 313/623

FOREIGN PATENT DOCUMENTS

JP 60-225159 11/1985
JP 2-301957 12/1990

* cited by examiner

*Primary Examiner*—Mariceli Santiago
*Assistant Examiner*—Anne M Hines
(74) *Attorney, Agent, or Firm*—Wenderoth, Lind & Ponack, L.L.P.

(57) ABSTRACT

A high-pressure discharge lamp having a support structure for supporting a light emission tube so as to restrict its displacement in a direction perpendicular to the axis line thereof. A pair of thermal-stress generation members generates thermal stresses due to a temperature change at a time of switching the high-pressure discharge lamp from an on status to an off status. The thermal stresses acts as forces directed downward in a vertical direction and outward with respect to the light emission tube on side tube portions of the light emission tube arranged in a posture where the axis line extends in a horizontal direction.

10 Claims, 8 Drawing Sheets

HIGH-PRESSURE DISCHARGE LAMP

RELATED APPLICATION

This application is based on Japanese Patent Application 2003-112351, and the contents thereof are incorporated in this application by reference.

BACKGROUND OF THE INVENTION

The present invention relates to a high-pressure discharge lamp. Specifically, the present invention relates to a high-pressure discharge lamp preferably used for lighting at such usages for high ceilings, stores, and streets.

Conventionally, high-pressure discharge lamps for such usage as high ceilings, stores, and streets comprise a light emission tube made of quartz glass or ceramic, an outer tube, and wire frames made of a conductive material for supporting the light emission tube at the outer tube (for example, refer to U.S. Pat. No. 6,326,721). Since the light emission tube of this kind of high-pressure discharge lamp is heated to a very high temperature during lighting, relieving the thermal stress generated in the light emission tube is critical for preventing the breakage of the light emission tube. U.S. Pat. No. 6,326,721 discloses a structure where the stress due to the thermal expansion of the light emission tube during lighting is relieved by a coil provided at one end of the wire frame.

Further, there are other prior art arrangements for similarly preventing the breakage of the light emission tube. In such prior arts, a compressive stress latently exerts the material of the light emission tube in advance in order to relieve the tensile stress to be generated on the surface of the light emission tube during lighting (for example, refer to Japan Patent Application Laid-open Publication No. 2-301957 and Japan Patent Application Laid-open Publication No. 60-225159). These prior art references intend to cancel the tensile stress generated during lighting by the compressive stress latently exerted, thereby preventing the breakage of the light emission tube.

The lighting conditions required for high-pressure discharge lamps have been changing recently. The conditions are broadly classified into two conditions. As a first condition, under the circumstance where these high-pressure discharge lamps, in particular, metal halide lamps, are required to have higher efficiency, the operation pressure in the light emission tube is required to be increased from a conventional pressure of several atms (about 5 to 9 atms) to a pressure of ten-odd atms (about 10 to 15 atms) to improve lighting efficiency. Several methods are available to raise the operation pressure. For example, a general method for increasing operation pressure is to make the light emission size smaller for increasing a load applied to a tube wall and raise the temperature of the light emission tube higher than a conventional temperature so as to accelerate evaporation of sealed metals. Another condition relates to the lighting posture of the lamp. Although the lamp has been used in a vertical lighting posture relatively frequently, the use of the lamp in a horizontal lighting posture is increasing in view of the design of lighting apparatuses, in particular, the design for attaining space-saving.

However, the above-mentioned prior art devices are all intended to relieve the thermal stress generated in the light emission tube during lighting at an operation pressure of several atms in a vertical lighting posture. The above-mentioned prior art devices do not provide countermeasures against the thermal stress generated in the light emission tube under at a high operation pressure of ten-odd atms in a horizontal lighting posture.

SUMMARY OF THE INVENTION

An object of the present invention is to relieve the thermal stress generated in the light emission tube of a high-pressure discharge lamp. More particularly, the present invention is intended to relieve the thermal stress generated in the light emission tube at a high operation pressure of several tens of atms and in a horizontal lighting posture, thereby preventing the breakage of the high-pressure discharge lamp.

A first aspect of the present invention provides a high-pressure discharge lamp, comprising a light emission tube having a light emission portion, a pair of electrodes disposed so as to be opposed to each other in the light emission portion, and a pair of side tube portions elongating from ends of the light emission portion along an axis line connecting the electrodes, a support structure for supporting the light emission tube so as to restrict a displacement of the light emission tube at least in a direction perpendicular to the axis line, and a pair of thermal-stress generation members, base end sides of which are supported by the support structure, and the tip end sides of which are connected to the side tube portions of the light emission tube, the thermal-stress generation members generating thermal stresses by a temperature change at a time of switching the high pressure lamp from an on status to an off status, and the thermal stresses acting as forces directed downward in a vertical direction and outward with respect to the light emission tube on the side tube portions of the light emission tube arranged in a posture where the axis line extends in a horizontal direction.

Under conditions where the lamp is used at a high operation pressure of about ten-odd atms in a horizontal lighting posture, the maximum thermal stress is generated in a vertically uppermost portion of the light emission portion by the temperature change at the time of switching the lamp from the on status to the off status. This thermal stress is a tensile stress. Because the thermal stresses generated by the thermal stress generation members act as forces directed downward in the vertical direction and outward with respect to the light emission tube on the side tube potions of the light emission tube, a compressive stress is exerted on the vertically uppermost portion of the light emission tube on which the maximum tensile stress is exerted. Therefore, the thermal-stress generation members relieve the thermal stress exerted on the light emission tube at the time of switching the lamp from the on status to the off status. This prevents the breakage or cracking of the light emission tube, resulting in that a lighting life of the high-pressure discharge lamp can be extended.

Specifically, the high-pressure discharge lamp comprises a pair of connection members for respectively connecting the side tube portions to the tip end sides of the thermal-stress generation members.

More specifically, the connection member comprises an annular portion surrounding an outer circumferential face of the side tube portion, and a fixed portion extending from the annular portion in a direction away from the side tube portion. The tip side end of the thermal stress generation member is fixed to the fixed portion. The connection member may be fixed to the side tube portion by crimping the annular portion onto the side tube portion. In this case, a groove into which the annular portion is fitted may be formed on the outer circumferential face of the side tube portion.

Where the electrodes extend in the direction of the axis line and protrude to an outside of the light emission tube through the tube portions, and where the support structure comprises wire frames for supporting the electrodes and electrically connecting the electrodes to a lighting circuit, the base ends of the pair of thermal-stress generation members may be fixed to a pair of support shafts extending respectively from the wire frames to the side tube portions.

The thermal-stress generation members are made of bimetal or a single metal material having a desired linear expansion coefficient.

The present invention is preferably applicable in the case when the light emission tube is made of a ceramic material. However, the light emission tube may also be made of other materials, such as quartz.

The present invention is preferably applicable in the case when the pressure generated by light emission substances filled in the light emission portion during lighting, that is, operation pressure, is equal to or higher than 10 MPa.

The high-pressure discharge lamp may further comprise an outer tube enclosing the light emission tube.

A second aspect of the present invention provides a high-pressure discharge lamp comprising, a light emission tube having a light emission portion, and a thermal-stress generation member for generating thermal stress by a temperature change at a time of switching the high-pressure discharge lamp from an on status to an off status so that the thermal stress generates a compression stress in an upper portion of the light emission portion.

BRIEF DESCRIPTION OF THE DRAWINGS

These and other objects and features of the invention will become apparent from the following description taken in conjunction with preferred embodiments of the invention with reference to the accompanying drawings, in which.

DETAILED DESCRIPTION OF THE PREFERRED EMBODIMENTS

The inventors of the present invention found that when a high-pressure discharge lamp was used at a high operation pressure in a horizontal lighting posture, a breakage of the light emission tube of the lamp such as cracking was apt to occur immediately after the lamp was switched from an on status to an off status. Further, the inventors analyzed the thermal stress that caused the breakage, as described below in detail. The present invention is based on new findings obtained by the analysis. The increase in the pressure and temperature at the starting of the lamp, i.e., at the time of switching the lamp from the Off status to the on status, depends on the evaporation of sealed metals, and thus the increase is sufficiently moderate. However, at a high operation pressure in a horizontal lighting posture, abrupt temperature drop occurs immediately after the lamp is turned off or at the time of switching from the on status to the off status.

Figure 1:
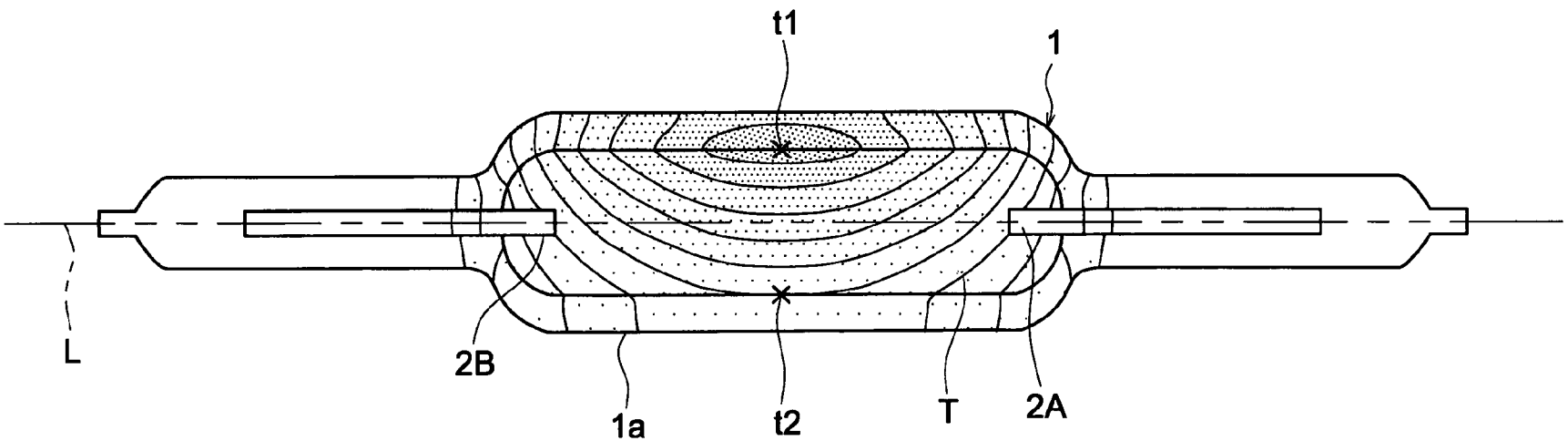
FIG. 1 is a schematic view showing the temperature distribution of a light emission tube during lighting.

FIG. 1 shows a temperature distribution of a light emission tube 1 of a metal halide lamp, which is a kind of high-pressure discharge lamp, during the period in which the light emission tube 1 is stably emitting the light. The light emission tube 1 is made of a ceramic material principally made from alumina ($Al_2O_3$). Sealed metals including mercury and metal halides are sealed in the light emission portion 1*a* as well as a rare gas serving as a buffer gas. The operation pressure is in the range of 10 to 15 Pa. Further, the light emission tube 1 is in a lighting posture (horizontal lighting posture) where an imaginary straight line connecting a pair of electrodes 2A and 2B disposed in the light emission tube 1 or the axis line L thereof extends in a nearly horizontal direction. The light emission tube 1 is supported so that it can thermally expand in the direction of the axis line L extending in the horizontal direction but its displacement in a direction perpendicular to the axis line L including a vertical direction is restricted.

In FIG. 1, the higher a density of the dots provided in each region defined by isothermal lines T is, the higher the temperature in the region is. Since part of the electric power to be supplied is consumed as thermal energy, the inside of the light emission portion 1*a* is heated at a high temperature of nearly 1,100° C. Further, since the lighting posture is horizontal, a temperature difference of nearly 100° C. occurs between the upper portion and the lower portion of the light emission tube 1. Specifically, although the temperature at the upper portion of the inner wall face of the light emission tube 1 designated by a point t1 is about 1,070° C., the temperature at the lower portion of the inner wall face of the light emission portion 1*a* designated by a point t2 is about 930° C. The temperature difference in the light emission portion 1*a* occurs as the result of a convection phenomenon in a high-temperature and high-pressure state due to a large amount of sealed metals filled in the light emission portion 1*a*. Therefore, the higher the pressure in the light emission portion 1*a* during lighting is, the larger the temperature difference is.

Figure 2:
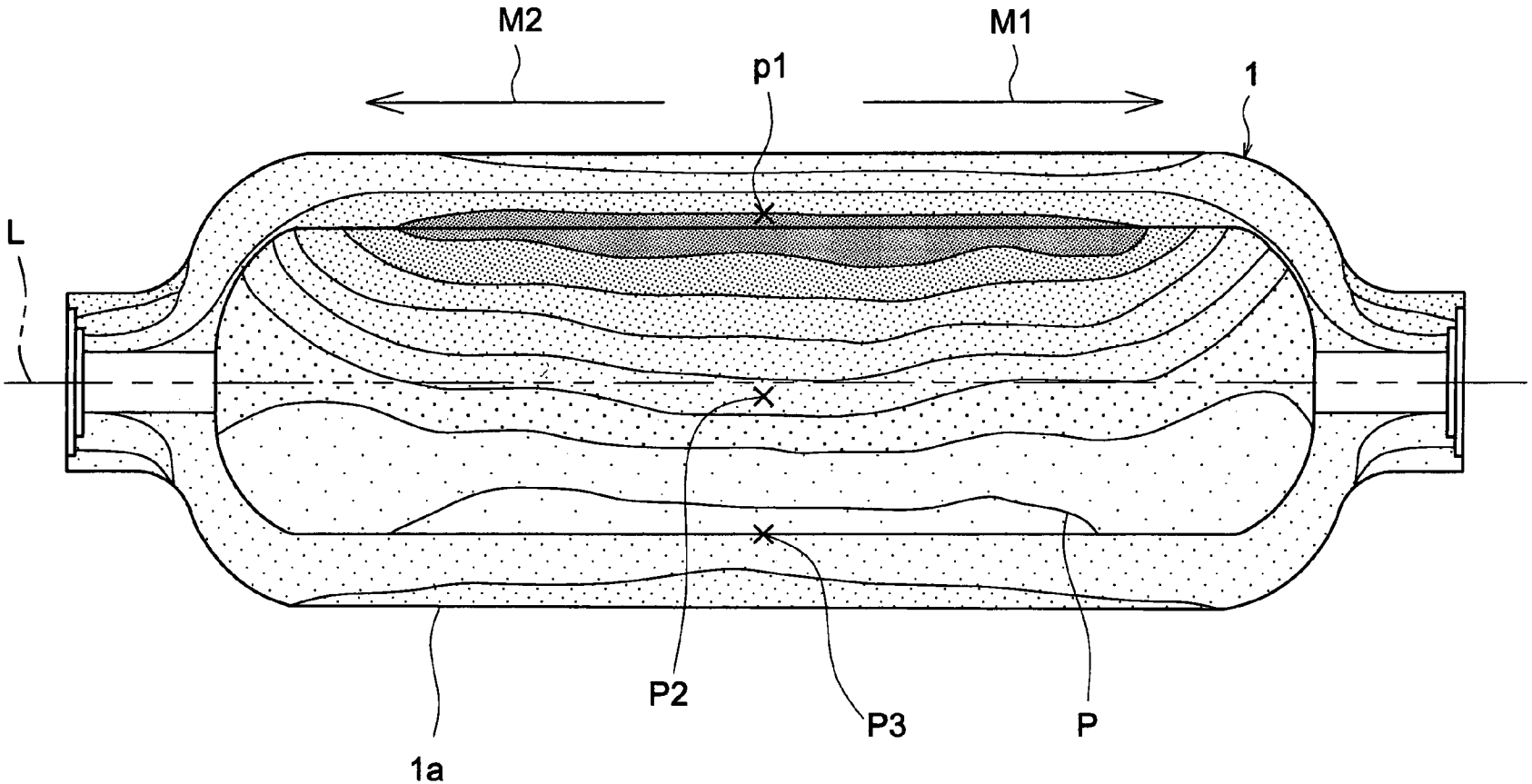
FIG. 2 is a schematic view showing the stress distribution of the light emission tube immediately after turning-off.

FIG. 2 shows a calculation result of stresses generated in various portions of the light emission portion 1*a* when the light emission portion 1*a* illuminating in such a high-temperature and high-pressure status was turned off by a simulation using the finite-element method. Specifically, FIG. 2 shows a distribution of the thermal stresses generated in the portions of the light emission portion 1 at a room temperature when the temperature distribution shown in FIG. 1 is changed in accordance with a condition which simulates actual measurement values of temperature decreases immediately after turning off. In FIG. 2, the higher the density of the dots provided in each region divided by constant stress lines P is, the larger the thermal stress in the region is. As clearly shown in FIG. 2, the largest tensile stress is generated in the upper portion of the inner wall face among the various portions of the light emission tube 1. The tensile stress at a point p1 in the uppermost portion of the inner wall face is the maximum (111 MPa). The tensile stress decreases in the lower portions. For example, the tensile stress at a point p2 in the vertically central portion of the inner wall face is 30 MPa. Further, a compression stress is generated on the lower side of the inner wall. For example, a compression stress of −40 MPa is generated at a point p3 in the lowermost portion of the inner wall face. As indicated by arrows M1 and M2 in FIG. 2, the tensile stress is generated in the directions of the side tube portions 1*b* and 1*c* of the light emission tube 1 (in the direction of the axis line L). The portion wherein the tensile stress is generated corresponds to a portion wherein the light emission tube is broken in actual lamp strength tests.

As discussed above, it is found that when a high-pressure discharge lamp is used at a high operation pressure in a horizontal lighting posture, a large tensile thermal stress is generated in the upper portion of the light emission tube at the time of switching the lamp from the on status to the off status, and that the thermal stress causes the breakage of the light emission tube.

Figure 3:
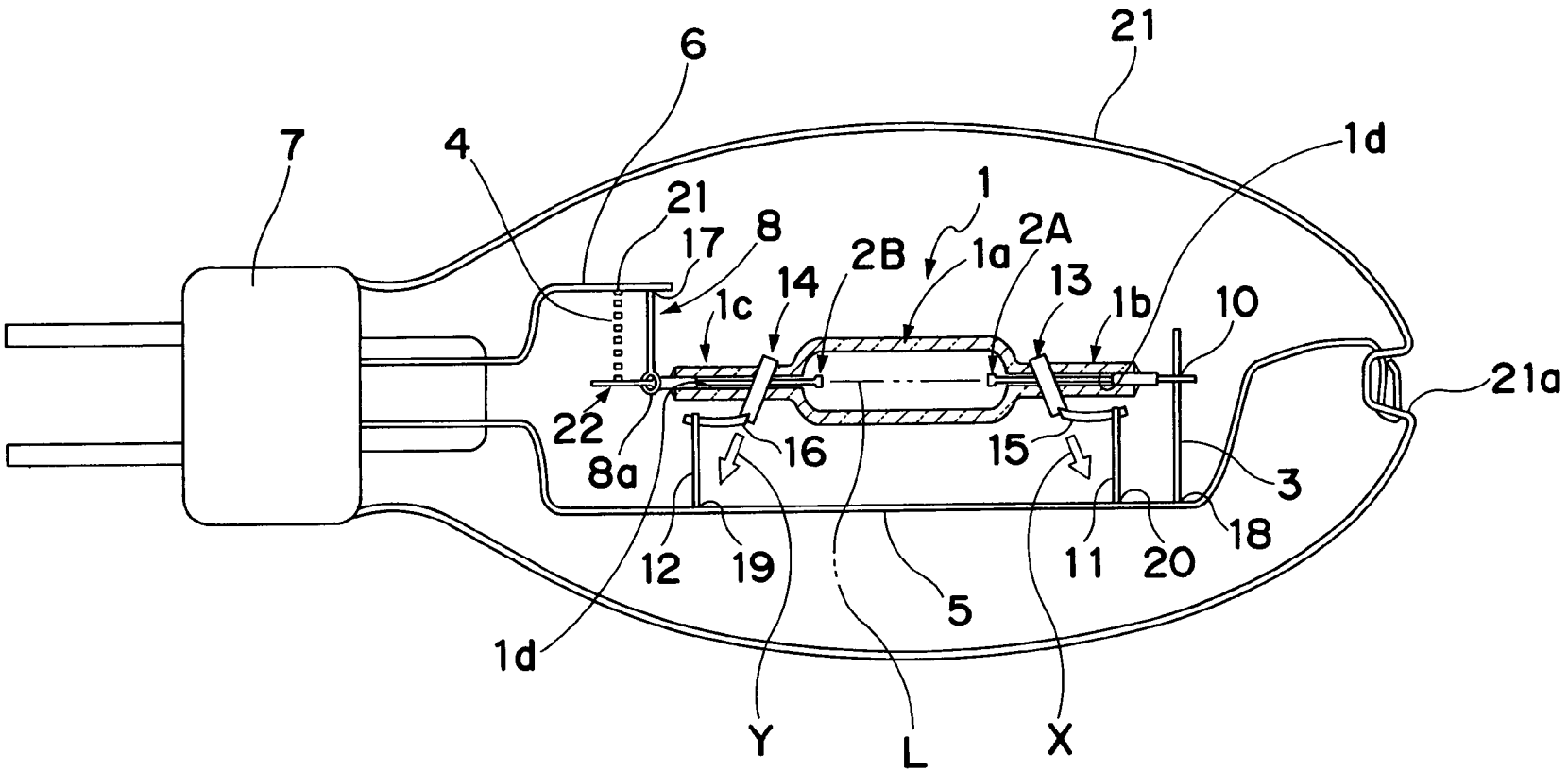
FIG. 3 is a schematic view showing a high-pressure discharge lamp according to an embodiment of the present invention.

Then, an embodiment of the present invention will be described below referring to the accompanying drawings. FIG. 3 shows a metal halide lamp as a high-pressure discharge lamp according to an embodiment of the present invention. A light emission tube 1 comprises a light emission portion 1*a* having a elongated hollow shape, a pair of side tube portions 1*b* and 1*c* extended from ends of the light emission portion 1*a*, and a pair of electrodes 2A and 2B. Tips of the electrodes 2A and 2B are exposed to the inside of the light emission portion 1*a*. The side tube portions 1*b* and 1*c* extend along an imaginary straight line connecting the electrodes 2A and 2B or along the axis line L. In this embodiment, the light emission portion 1*a* and the side tube portions 1*b* and 1*c* are made of a ceramic material principally made from alumina ($Al_2O_3$). The base ends of the electrodes 2A and 2B pass through the narrow tubes id and are guided to the outside of the light emission tube 1. An outer tube 1 is provided so as to enclose the light emission tube 1.

The electrical connection structure of the lamp will be described below. The base end of the electrode 2A on the right side in the figures is connected to a support member 3, whereas the base end of the electrode 2B in the left side is connected to a deformable member 4. Further, the support member 3 is connected to a wire frame 5, whereas the deformable member 4 is connected to a wire frame 6. The wire frames 5 and 6 are connected to an external lighting circuit (not shown) through a lamp base 7.

Sealed metals serving as light emission materials such as mercury and a rare gas serving as a buffer gas such as metal halides are filled in the light emission portion 1*a*. The pressure in the light emission portion 1*a* during lighting, that is, the operation pressure, is in the range of 10 to 15 MPa. Further, the lighting posture of the lamp is horizontal. Specifically, the metal halide lamp is arranged so as to take a lighting posture where the axis line L connecting the pair of electrodes 2A and 2B elongates in a nearly horizontal direction.

Next, the support structure of the light emission tube 1 will be described below. The wire frame 5 of the two wire frames extends from the lamp base 7 in the horizontal direction by passing along the lower side of the light emission tube 1. A tip end of the wire frame 5 is fixed to a dimple portion 21*a* of the outer tube 21. The other wire frame 6 extends from the lamp base 7 in the horizontal direction. A tip end of the wire frame 6 is positioned near the side tube portion 1*c* of the light emission tube 1. Further, the tip end of the wire frame 6 is positioned higher than the light emission tube 1. The base end of the electrode 2A on the right side is mechanically supported by the wire frame 5, and the base end of the electrode 2B on the left side is mechanically supported by the wire frame 6.

Generally, the light emission tube 1 expands due to thermal expansion when the lamp is stably lighting comparing to when the lamp is cold. This thermal expansion of the light emission tube 1 is the largest in the horizontal direction (in the direction of the axis line L). The light emission tube 1 is supported so that the stress generated by the thermal expansion in the light emission tube 1 during lighting is relieved. First, corresponding to the base end of the electrode 2B on the left side of the figure, the deformable member 4 and a support member 8, both extending in the vertical direction, are provided. The deformable member 4 is made of a material being conductive and deformable relatively freely such as a stranded wire made of a conductive material. An upper end of the deformable member 4 is welded to the wire frame 6 at the connection point 21, whereas its lower end is welded to the base end of the electrode 2B at the connection point 22. An upper end of the support member 8 is welded to the wire frame 6 at the connection point 17, whereas its lower end is provided with a ring-shaped portion 8*a*. The base end of the electrode 2B is inserted into the ring-shaped portion 8*a* but not fixed to the ring-shaped portion 8*a*. On the other hand, corresponding to the base end of the electrode 2A on the right side of the figure, the support member 3 extending in the vertical direction is provided. The lower end of the support member 3 is welded to the wire frame 5 at the connection point 20. The base end of the electrode 2A is welded to the support member 3 at the connection point 10. Because the left electrode 2B is inserted into the ring-shaped portion 8*a* and the deformable member 4 is deformable, the electrode 2B can be displaced in the direction of the axis line L. However, the displacement of the electrode 2B in a direction perpendicular to the horizontal direction (including the vertical direction) is restricted by the ring-shaped portion 8*a*. On the other hand, because the right electrode 2A is fixed to the support member 3, its displacement is restricted in the direction of the axis line L and in a direction perpendicular to the horizontal direction. Therefore, the light emission tube 1 can expand in the horizontal direction along the axis line L. Although the expansion relives the stress generated in the light emission tube 1, the displacement in a direction perpendicular to the horizontal direction is restricted.

When the light emission tube 1 is assumed to be a beam, its right end is a fixed end fixed to the support member 3 and its left end is a rotational end. At the rotational end, only the displacement in the direction perpendicular to the axis line is restricted by the ring-shaped portion 8*a*.

Figure 4:
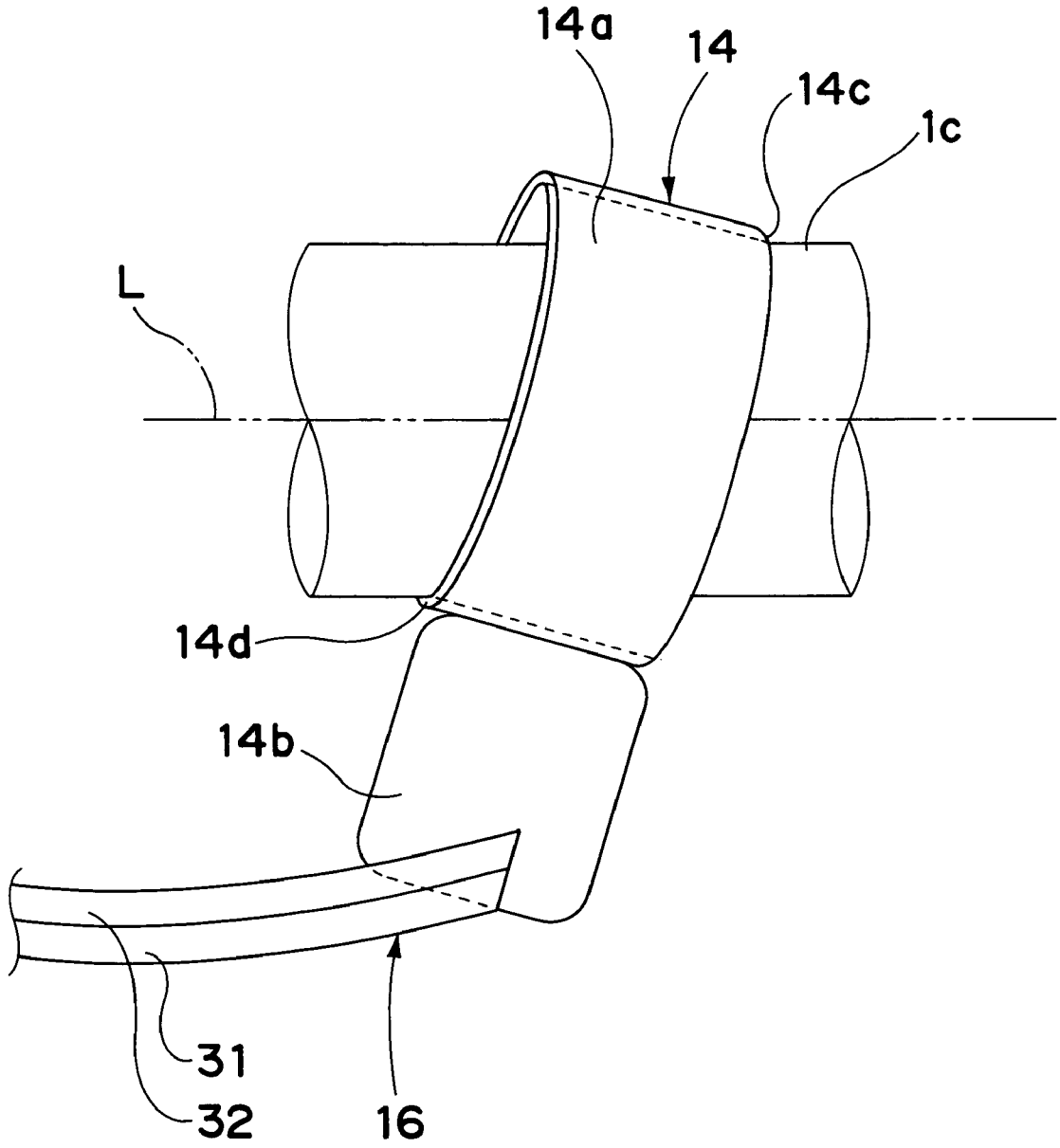
FIG. 4 is a partially enlarged view of FIG. 3 showing a connection member.
Figure 5:
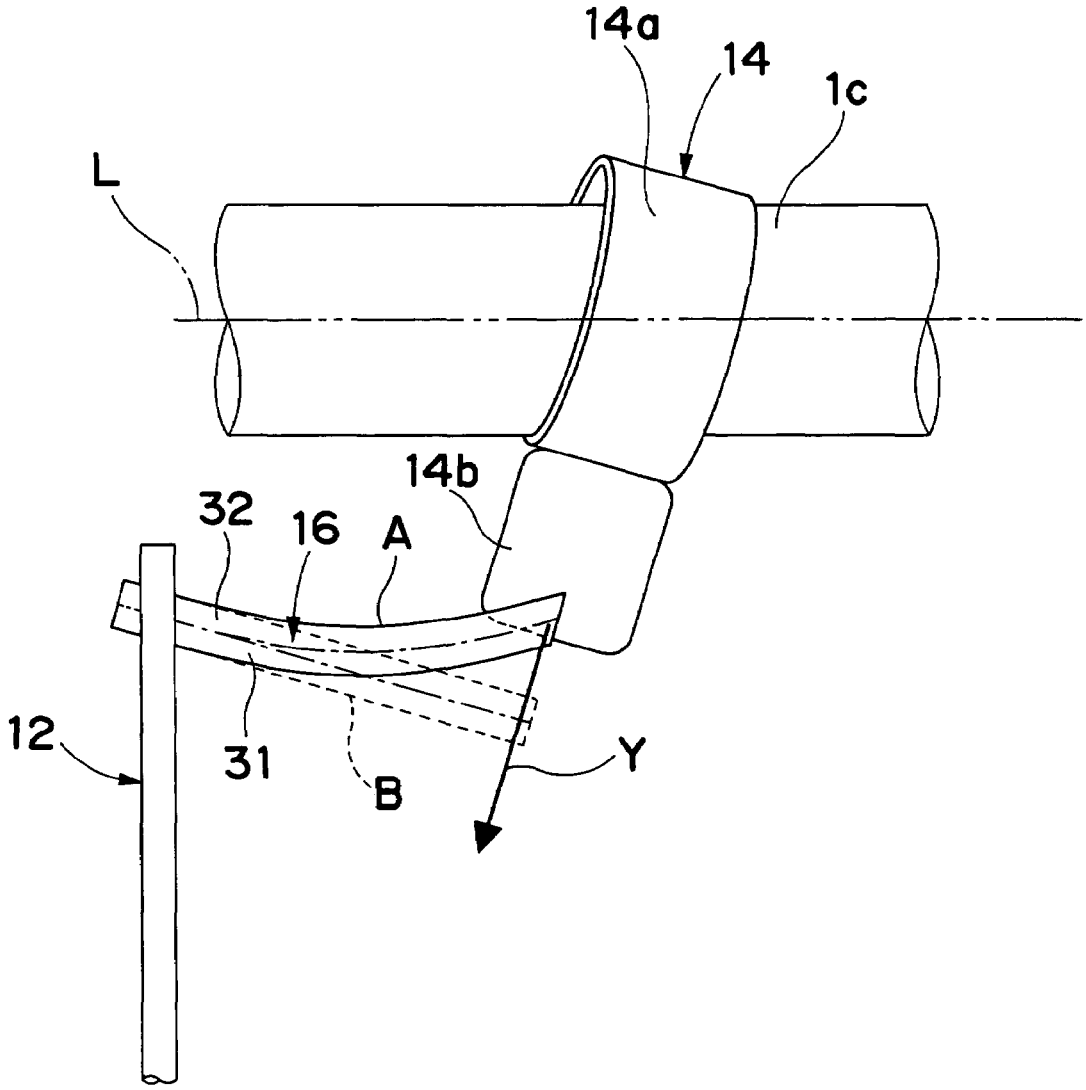
FIG. 5 is a partially enlarged view for illustrating the structure and function of a bimetallic strip.

Next, structures for relieving the thermal stress generated in the light emission tube 1 at the above-mentioned turning-off of the lamp will be described below with reference to FIGS. 3 to 5.

Support shafts 11 and 12, each extending upward in the vertical direction, are connected to the wire frame 5. The support shaft 11 is disposed under the side tube portion 1*b* on the right side of the figure. Its lower end is welded to the wire frame 5 at the connection point 20, and its upper end is opposed to the side tube portion 1*b* with a clearance therebetween. On the other hand, the support rod 12 is disposed under the side tube portion 1*c* on the left side of the figure. Its lower end is welded to the wire frame 5 at the connection point 19, and its upper end is opposed to the side tube portion 1*c* with a clearance therebetween.

Fixtures or connection members 13 and 14 are respectively attached on the side tube portions 1*b* and 1*c*. Referring to FIG. 4, the connection member 14 is formed of a band-shaped metal plate and comprises an annular portion 14*a* attached so as to be wound around the outer circumferential face of the side tube portion 1*c* and a fixed portion 14*b* extending downward from the annular portion 14*a*. The annular portion 14*a* is wound obliquely around the side tube portion 1*c*. A contact position 14*c* of the annular portion 14*a* making contact with the upper portion of the side tube portion 1*c* is positioned inwardly with respect to the other contact position 14*d* of the annular portion 14*a* making contact with the lower portion of the side tube portion 1*c*. In other words, the contact position 14*c* is positioned on the side of the light emission portion 1*a*. The annular portion 14*a* is attached so as not to be displaced easily from the side tube portion 1*c*, whereby the contact positions 14*d* and 14*c* are stationary. The connection member 13 is similar to the connection member 14 in material, shape, and the installation posture with respect to the side tube portion 1*b*.

The support shafts 11 and 12 are respectively connected to the connection members 13 and 14 by bimetallic strips 15 and 16 serving as thermal-stress generation members. Referring to FIG. 5, a base end of the bimetallic strip 16 is welded to the support rod 12, and its tip end is welded to the fixed portion 14*b* of the connection member 14. The bimetallic strip 16 comprises a plate (high thermal expansion plate 31) made of an alloy material having a high thermal expansion coefficient and a plate (low thermal expansion plate 32) made of an alloy material having a low thermal expansion coefficient, the two plates being laminated together. The bimetallic strip 16 has a thermal deformation effect. In other words, when the temperature rises, the deformation of the high thermal expansion plate 31 becomes larger than that of the low thermal expansion plate 32, thereby the bimetallic strip 16 is bent inward on the side of the low thermal expansion plate 32. In this embodiment, the bimetallic strip 16 is disposed so that the low thermal expansion plate 32 is positioned above the high thermal expansion plate 31 in the vertical direction, that is, on the side of the light emission tube 1. Further, the high thermal expansion plate 31 and the low thermal expansion plate 32 are selected with respect to material, shape and dimensions, and fixed to the support rod 12 and the connection member 14 so that the bimetallic strip 16 is bent inward on the side of the low thermal expansion plate 32 by the heat radiated from the light emission tube 1 during stable lighting as indicated by solid lines A in FIG. 5. The structure and installation posture of the bimetallic strip 15 connected to the support shaft 11 and the connection member 13 are similar to those of the bimetallic strip 16.

Figure 6:
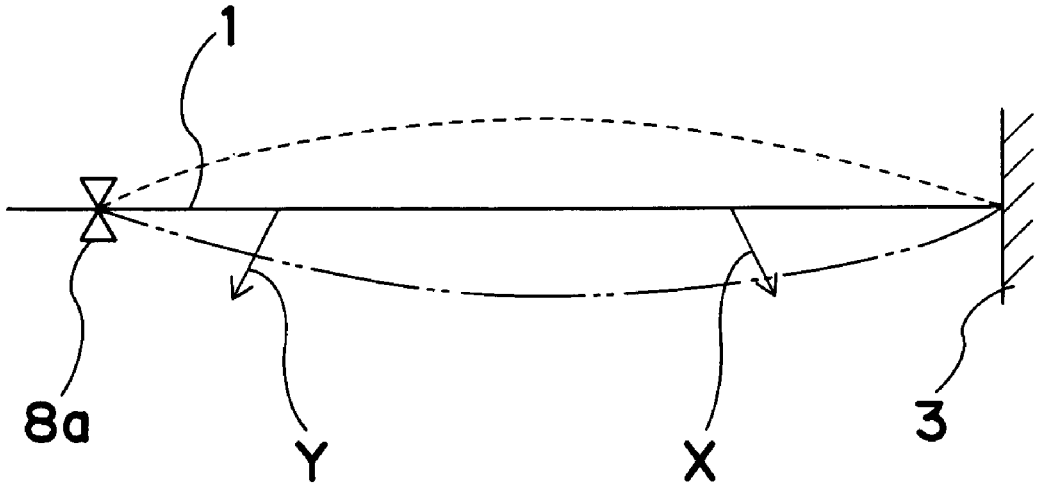
FIG. 6 is a conceptual view illustrating a method for supporting the light emission tube.

In the metal halide lamp according to the embodiment, its lighting operation pressure is high (10 to 15 MPa), and its lighting posture is horizontal. Hence, as described with reference to FIGS. 1 and 2, a large tensile thermal stress is generated in the upper portion of the light emission tube 1 at the time of switching the lamp from the on status to the off status. This thermal stress is exerted on the light emission tube 1 as a deformation force for deforming the light emission portion 1*a* into an arch shape protruding upward in the vertical direction as schematically indicated by a broken line in FIG. 6.

On the other hand, immediately after the metal halide lamp is turned off, the heat radiated from the light emission tube 1 abruptly decreases to cause temperature drop. Thus, the high thermal expansion plate material 31 of each of the bimetallic strips 15 and 16 starts shrinking abruptly. Referring to FIG. 5 again, if the bimetallic strip 16 were not welded to the connection member 14, the bimetallic strip 16 would be deformed abruptly into the straight-line shape indicated by broken lines B due to the temperature drop. However, since both ends of the bimetallic strip 16 are welded to the support rod 12 and the connection member 14 so as to restrict such deformation in reality, the bimetallic strip 16 is hardly deformed from the shape indicated by solid lines A, resulting in that a thermal stress is generated. This thermal stress generated in the bimetallic strip 16 is exerted on the side tube portion 1*c* of the light emission tube 1 via the connection member 14 as a force as indicated by an arrow Y. Also referring to FIG. 3, a thermal stress is also generated in the bimetallic strip 15 due to the above-mentioned temperature drop immediately after the lamp is turned off. This thermal stress is exerted on the side tube portion 1*b* of the light emission tube 1 via the connection member 13 as a force as indicated by an arrow X. The directions of the forces X and Y exerted on the side tube portions 1*b* and 1*c* due to the thermal stresses generated in the bimetallic strips 15 and 16 are obliquely downward, more specifically, downward in the vertical direction with respect to the side tube portions 1*b* and 1*c* and outward (away from the light emission portion 1*a*) with respect to side tube portions 1*b* and 1*c*. Therefore, as schematically indicated by an alternate long and short dash line, these forces X and Y are exerted on the light emission tube 1 as forces for deforming the light emission portion 1*a* into an arch shape protruding downward in the vertical direction, thereby generating a compression stress in the upper portion of the inner wall face of the light emission tube 1. In other words, the forces X and Y cause deformation of the light emission tube 1 in a direction opposite to the direction of the deformation (indicated by the broken line in FIG. 6) of the light emission tube 1 due to the thermal stress generated in the light emission tube 1 at the time of switching the lamp from the on status to the off status. Accordingly, the tensile thermal stress generated on the inner wall face of the light emission portion 1*a* immediately after the light emission tube 1 is turned off, in particular, the thermal stress in the uppermost portion (at the point t1 in FIG. 2) of the inner wall face of the light emission portion 1*a*, is effectively relieved by the forces X and Y exerted on the light emission tube 1 from the bimetallic strips 15 and 16 through the connection members 13 and 14.

Figure 7A:
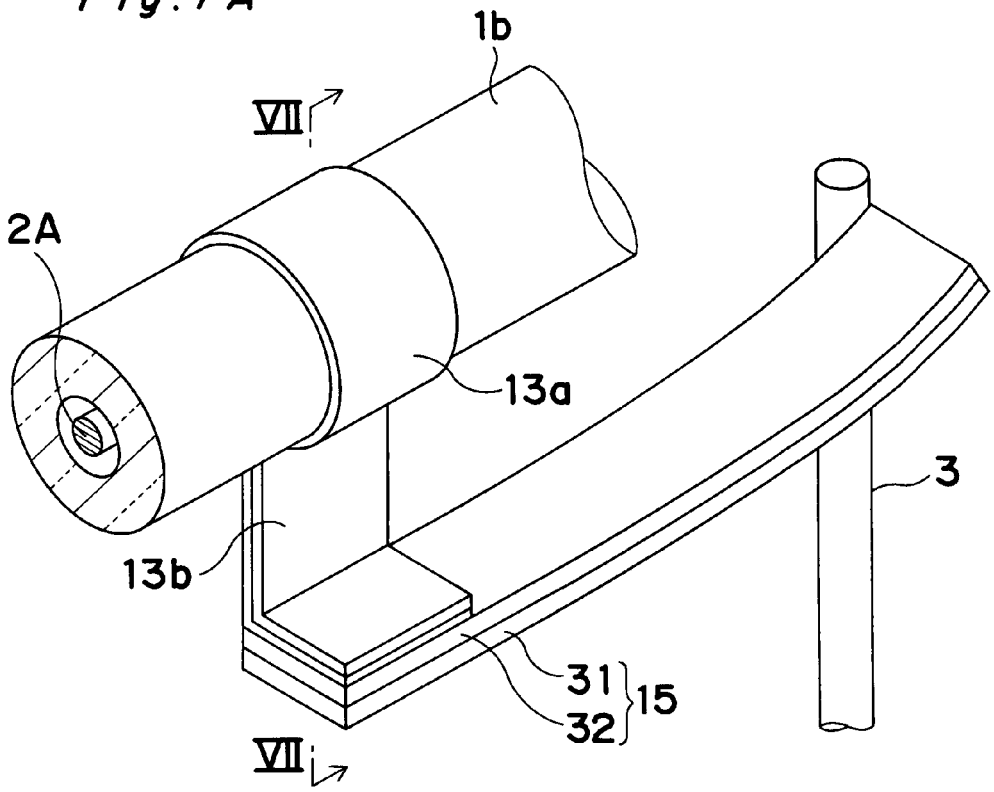
FIG. 7A is a partially enlarged perspective view showing another example of the connection member.
Figure 7B:
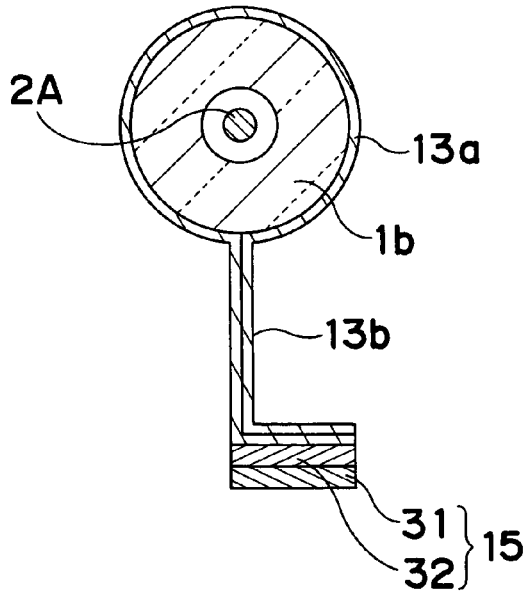
FIG. 7B is a sectional view taken along a line VII—VII of FIG. 7A.

FIGS. 7A and 7B show another example of the connection member. The annular portion 13*a* of the connection member 13 is crimped onto the side tube portion 1*b*, thereby the entire inner face of the annular portion 13*a* tightly contacts with the outer circumferential face of the connection member 13. Further, the lower end of the fixed portion 13*b* is bent, and the bent portion is welded to the upper face of the bimetallic strip 15. Since the connection member 13 is firmly fixed to the side tube portion 1*b* by crimping the annular portion 13*a* onto the side tube portion 1*b*, the thermal stress generated in the bimetallic strip 15 at the turning off the lamp is securely or reliably transmitted to the light emission tube 1 via the connection member 13. A structure similar to this may also be applied to the other connection member 14 (see FIG. 3).

Figure 8A:
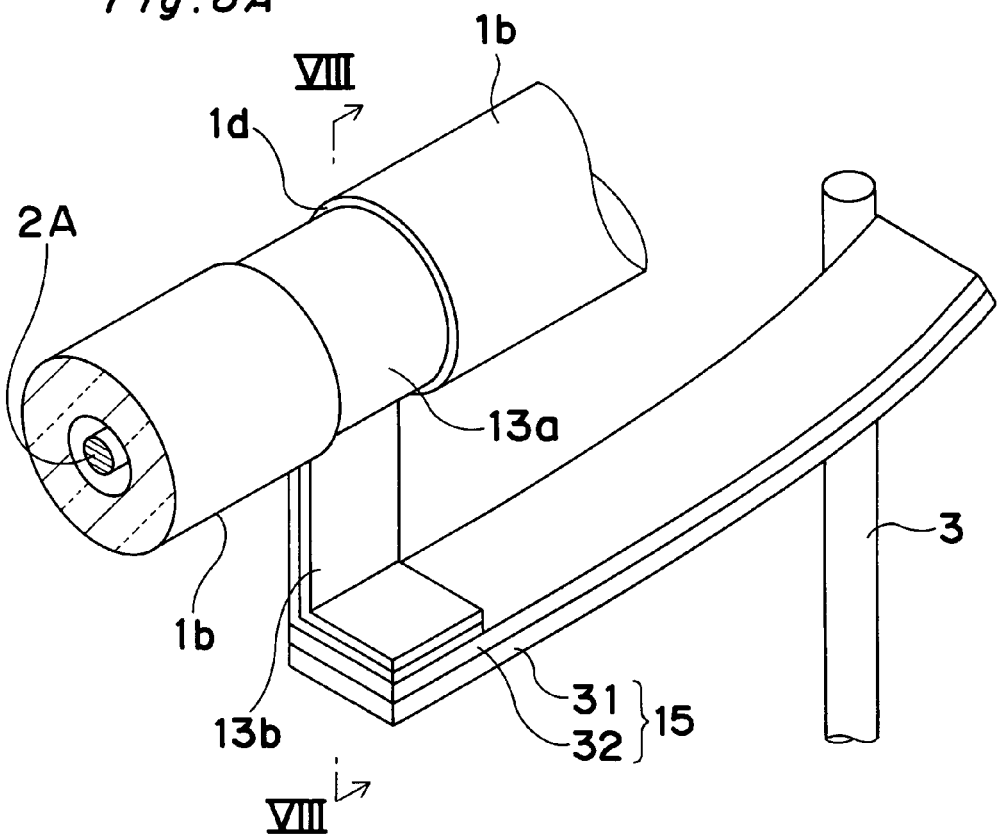
FIG. 8A is a partially enlarged perspective view showing still another example of the connection member.
Figure 8B:
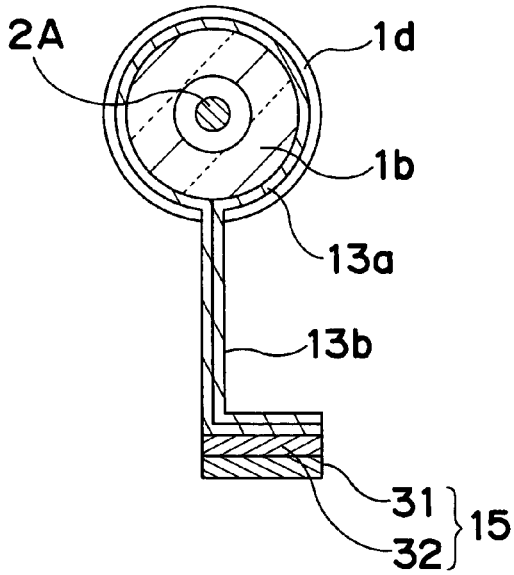
FIG. 8B is a sectional view taken along a line VIII—VIII of FIG. 8A.

FIGS. 8A and 8B show still another example of the connection member. An annular groove 1*d* is formed on the outer circumferential face of the side tube portion 1*b*. The annular portion 13*a* of the connection member 13 is fitted into the groove 1*d*. The annular portion 13*a* is crimped onto the side tube portion 1*b*. Since the annular portion 13*a* is fitted into this groove 1*d*, the annular portion 13*a* is securely prevented from being displaced with respect to the side tube portion 1*b* in the direction of the axis line L. Therefore, the thermal stress of the bimetallic strip 15 is more reliably or securely transmitted to the light emission tube 1. A structure similar to this may also be applied to the other connection member 14 (see FIG. 3).

The relief of the tensile stress in the vertically upper portion of the light emission portion 1*a* configured as described above is more effective as the pressure in the light emission portion 1*a* is higher. The relief is particularly effective in the case when the inner pressure at the turning-on time of the light emission portion 1*a* is 10 MPa (about 10 atms). For raising the pressure in the light emission portion 1*a* to equal to or higher than 10 MPa at during the period when the lamp is lighting, a mixture of $PrI_3$, CsI and NaI can be adopted as substances to be sealed.

There are some points to be considered in design so that the effect of relieving the tensile stress of the light emission portion 1*a*, configured as described above, is produced sufficiently. A first point is that the wire frames 5 and 6, the support members 3 and 8, and the support shafts 11 and 12 should have high strength. In order that the thermal stresses generated in the bimetallic strips 15 and 16 are effectively exerted as the forces X and Y for relieving the tensile thermal stress of the light emission portion 1*a*, members around the light emission portion 1*a*, i.e., the wire frames 5 and 6, the support members 3 and 8, and the support shafts 11 and 12 are required to be designed with respect to material, shape, and dimensions so as not to be deformed easily. In the case when stainless steel is used as a conductive metal material, its diameter is desired to be equal to or more than 0.5 mm. Similarly, it is needless to say that strong welding is necessary at the connection points 10 and 17 through 20 so that the members used for support do not easily become unsteady.

A second point relates to cooling speed of the bimetallic strips 15 and 16. The alumina or quartz constituting the light emission tube 1 is higher in specific heat and lower in heat conductivity in comparison with metallic materials constituting members such as the support shafts 11 and 12, and the bimetallic strips 15 and 16. Thus, when the light emission tube 1 is switched from the on status to the off status, the cooling speed of the bimetallic strips 15 and 16 is sufficiently higher than that of the light emission tube 1. However, as a measure for further safety, the support shafts 11 and 12 may be provided with a structure, such as a cooling fin, having a large surface area so that heat radiation from the support shafts 11 and 12 is accelerated, thereby increasing cooling speed of the support shafts 11 and 12 immediately after the turning off.

In addition, the above-mentioned embodiment is provided with the support shafts 11 and 12 designed specially for supporting the bimetallic strips. However, in the case when no sufficient space is obtained in the lamp, the support members 3 and 8 for the light emission tube 1 may also be used to support the bimetallic strips 15 and 16.

Further, although the bimetallic strips are adopted as thermal-stress generation members for generating thermal stresses due to the temperature change in the above-mentioned embodiment, the thermal-stress generation members may be made of a single metal material having a required expansion coefficient depending on the shape of the light emission tube, and the magnitude and direction of a compressive stress required to be exerted on the light emission tube. In other words, the thermal-stress generation members should only generate thermal stresses due to the temperature change of the light emission portion 1*a*, and the thermal stresses should only act as forces in the directions for relieving the thermal stress generated in the light emission portion 1*a*.

Furthermore, in the above-mentioned embodiment, the ceramic material is used as the material of the light emission tube 1. However, it is needless to say that the present invention is applicable even when other materials generally used, such as quartz glass, are used for the light emission tube 1. In the case when ceramic having a high expansion coefficient is used for the light emission tube 1, the light emission tube 1 has a relatively high possibility of breakage, such as cracking. Thus, the present invention is preferably applicable in the case when the material of the light emission tube 1 is ceramic.

Although the present invention has been fully described in conjunction with preferred embodiments thereof with reference to the accompanying drawings, various changes and modifications are possible for those skilled in the art. Therefore, such changes and modifications should be construed as included in the present invention unless they depart from the intention and scope of the invention as defined by the appended claims.

What is claimed is:

1. A high-pressure discharge lamp, comprising:

a light emission tube having a light emission portion, a pair of electrodes disposed so as to be opposed to each other in the light emission portion, and a pair of side tube portions elongating from ends of the light emission portion along an axis line connecting the electrodes, a support structure for supporting the light emission tube so as to restrict a displacement of the light emission tube at least in a direction perpendicular to the axis line, and a pair of thermal-stress generation members, base end sides of which are supported by the support structure, and tip end sides of which are connected to the side tube portions of the light emission tube, the thermal-stress generation members generating thermal stresses by a temperature change at a time of switching the high pressure lamp from an on status to an off status, and the thermal stresses acting as forces directed downward in a vertical direction and outward with respect to the light emission tube on the side tube portions of the light emission tube arranged in a posture where the axis line extends in a substantially horizontal direction.

2. A high-pressure discharge lamp according to claim 1, further comprising a pair of connection members for respectively connecting the side tube portions to the tip end sides of the thermal-stress generation members.

3. A high-pressure discharge lamp according to claim 2, wherein each of the connection members comprises an annular portion surrounding an outer circumferential face of the respective side tube portion, and a fixed portion extending from the annular portion in a direction leaving away from the respective side tube portion, the tip side end of the thermal stress generation member being fixed to the fixed portion.

4. A high-pressure discharge lamp according to claim 3, wherein each of the connection members is fixed to the respective side tube portion by crimping the annular portion onto the respective side tube portion.

5. A high-pressure discharge lamp according to claim 4, wherein a groove into which the annular portion is fitted is formed on the outer circumferential face of the respective side tube portion.

6. A high-pressure discharge lamp according to claim 1, wherein the electrodes extend in the direction of the axis line and protrude to an outside of the light emission tube through the tube portions, wherein the support structure comprises wire frames for supporting the electrodes and electrically connecting the electrodes to a lighting circuit, and wherein the base ends of the pair of thermal-stress generation members are fixed to a pair of support shafts respectively extending from the wire frames to the side tube portions.

7. A high-pressure discharge lamp according to claim 1, wherein the thermal-stress generation members are made of bimetal.

8. A high-pressure discharge lamp according to claim 1, wherein the light emission tube is made of a ceramic material.

9. A high-pressure discharge lamp according to claim 1, wherein a light emission substance is sealed in the light emission tube, and wherein the pressure of the light emission substance during lighting is equal to or higher than 10 MPa.

10. A high-pressure discharge lamp according to claim 1, further comprising an outer tube enveloping the light emission tube.

* * * * *